United States Patent [19]

Moffet et al.

[11] 4,287,761

[45] Sep. 8, 1981

[54] MUD SAMPLING CHAMBER

[75] Inventors: John N. Moffet; John D. Moffet, both of Wichita Falls, Tex.

[73] Assignee: Energy Detection Company, Wichita Falls, Tex.

[21] Appl. No.: 115,002

[22] Filed: Jan. 24, 1980

[51] Int. Cl.[3] ..... E21B 47/00

[52] U.S. Cl. ..... 73/153

[58] Field of Search ..... 73/153, 422 R; 220/1 S, 220/DIG. 13; 217/5, 17; 137/551

[56] References Cited

U.S. PATENT DOCUMENTS

| | | | |
|---|---|---|---|
| 999,117 | 7/1911 | Luckett | 217/5 |
| 4,134,294 | 1/1979 | Patillet et al. | 73/153 |

OTHER PUBLICATIONS

Pp. 515-520 from History of Petroleum Engineering, Published by American Petroleum Institute, 1961.

*Primary Examiner*—Jerry W. Myracle

*Attorney, Agent, or Firm*—Richards, Harris & Medlock

[57] ABSTRACT

A flow chamber (10) for sampling drilling mud on a continuous basis comprises a rigid box (18) having an inlet (34) and an outlet (36). The box (18) is of rectangular cross-section which increases in depth and decreases in width from front to back to facilitate flow of drilling mud therethrough. A fitting (42) is provided in the top side of the box (18) for receiving a hydrocarbon sensor.

10 Claims, 4 Drawing Figures

MUD SAMPLING CHAMBER

TECHNICAL FIELD

The present invention in general relates to a fluid flow chamber. More particularly, this invention concerns a chamber for placement in a drilling mud circulation system to facilitate analysis of the mud-laden fluid circulated through a bore hole during drilling.

BACKGROUND ART

During the drilling of oil or gas wells, mud-laden fluid or "drilling mud" is often circulated through the hole for cooling and lubricating the drill bit, and for removing cuttings from the well. Drilling mud comprises a mixture of soil and water, and is usually held in a surface pond or pit adjacent to the well. The drilling mud is pumped into the hole and is then returned to the pit where the various cuttings are deposited.

The drilling mud provides a means of communicating with the bottom of the hole and with the geological formations penetrated by the bit during drilling. By appropriate measurements at the surface, before the drilling mud is returned to the pit, useful data such as the concentration of oil, gas, water, or sulfur in the drilling mud or cuttings, rate of drilling penetration, etc. can be determined through mud analysis. These data are then correlated with depth to provide a readout of information during drilling of the well.

Examination of drilling mud and the cuttings carried thereby is known as mud logging. Although discrete samples of drilling mud can be collected and analyzed, it is preferable to conduct sampling on a continuous basis. For example, the control and amount of information afforded by continuous mud logging is particularly desirable during drilling of exploratory holes, or when the stratigraphy is complicated. The mud sampling chambers of the prior art, however, have had a tendency to fill up and become clogged, which in turn has resulted in analysis of stagnant samples, improper sampling times, and other difficulties adversely affecting the accuracy and reliability of the procedure. Thus, a need has arisen for an improved flow chamber for sampling drilling mud on a continuous basis.

DISCLOSURE OF INVENTION

The present invention comprises a mud sampling chamber which overcomes the foregoing and other difficulties associated with the prior art. In accordance with the invention, there is provided a mud sampling chamber characterized by the absence of false corners to resist clogging and facilitate the flow of drilling mud therethrough so that no stagnant mud can collect in the chamber.

More specifically, the present invention comprises a chamber for connection in the drilling mud return line for sensing hydrocarbons in the drilling mud on a continuous basis during mud logging operations. The box is of rectangular cross-section which changes in height and width between the inlet and outlet ends to facilitate continuous flow of drilling mud therethrough and thereby enhance the reliability of the mud logging procedure. The bottom wall of the chamber is inclined relative to the top wall so that the inlet is positioned above the outlet. A fitting for a hydrocarbon sensor, a plurality of sight glasses, and a handle are preferably provided in the top wall of the chamber.

BRIEF DESCRIPTION OF DRAWINGS

A more complete understanding of the invention can be had by reference to the following Detailed Description in conjunction with the accompanying Drawings, wherein.

DETAILED DESCRIPTION

Figure 1:
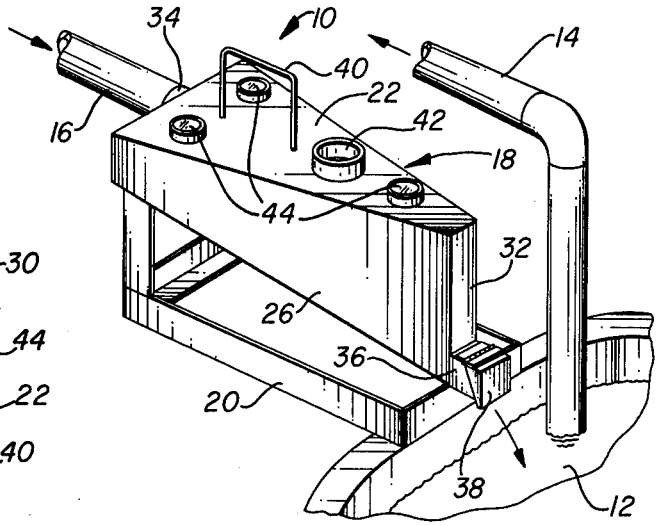
FIG. 1 is a perspective view of part of a drilling mud circulation system incorporating the sampling chamber of the invention.

In the Drawing, like reference numerals designate like or corresponding elements throughout the views.

FIG. 1 shows a portion of a drilling mud circulation system incorporating a sampling chamber 10 constructed in accordance with the invention. Drilling mud from a pit 12 is pumped through pipe 14 to the well (not shown) being drilled. After passage through the bore hole the drilling mud and cuttings carried thereby are returned to pit 12 via return line 16 and sampling chamber 10. As the drilling mud is returned to pit 12, sampling chamber 10 is employed in the analysis of the mud for hydrocarbons to provide a record or log of the well.

Figure 2:
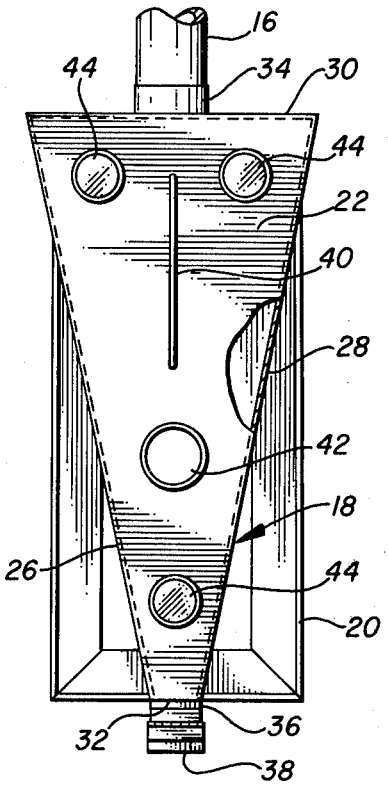
FIG. 2 is a top view (partially cutaway) of the invention.
Figure 3:
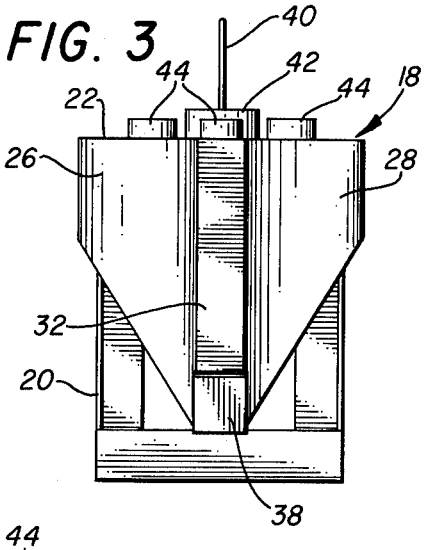
FIG. 3 is an end view of the invention.
Figure 4:
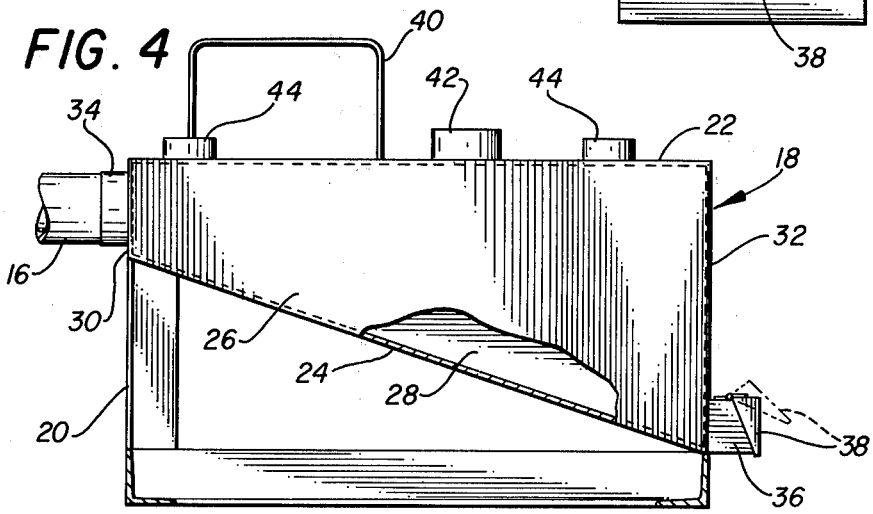
FIG. 4 is a side view (partially cutaway) of the invention.

The structural details of sampling chamber 10 are shown in FIGS. 2–4. Chamber 10 includes a box 18 which is supported on a stand 20. Box 18 can be constructed of any suitable material, such as steel or other metal. Box 18 is comprised of a substantially level top wall 22, an inclined bottom wall 24, a pair of side walls 26 and 28, and end walls 30 and 32. The top and bottom walls 22 and 24 are generally triangular in shape, while the side walls 26 and 28 have the general forms of right triangles. End walls 30 and 32 are rectangular in shape.

Back end wall 30 includes a fitting 34 for connection to the return line 16. Front endwall 32 includes an outlet 36 covered by a hinged trap door 38. Outlet 36 is preferably square and substantially equal in width to front end wall 32 to eliminate false corners. It will thus be apparent that inlet 34 is positioned above outlet 36 of sampling chamber 10.

A handle 40 and a fitting 42 are provided in the top wall 22 of sampling chamber 10. Handle 40, of course, is for portability. Fitting 42 is adapted to receive a suitable hydrocarbon sensor (not shown) for detection of oil and gas in the drilling mud and cuttings carried thereby. In the preferred embodiment of sampling chamber 10, top wall 22 also includes a plurality of sight glasses 44 for visual observation of the drilling mud, or for connection of optical devices thereto.

When sampling chamber 10 is connected to return line 16, the drilling mud enters box 18 through inlet 34 and flows downwardly along bottom wall 24, with the assistance of gravity, through outlet 36 and back into pit 12. It will be appreciated that there are no false corners within box 18 which would tend to impede or clog fluid flow through chamber 10. This is a significant feature of the invention. This construction permits sufficient time for sampling, while preventing accumulation of stagnant drilling mud. Bottom wall 24 can be of any suitable angle of inclination. For example, an 18 degree angle of inclination has been found satisfactory.

From the foregoing, it will be apparent that the present invention comprises a mud sampling chamber having several advantages over the prior art. The construction of the invention facilitates continuous flow of drilling mud therethrough to avoid clogging and accumulation of stagnant mud, while allowing sufficient sampling time. Other advantages will be apparent to those skilled in the art.

Although a particular embodiment of the invention has been illustrated in the accompanying Drawings and described in the foregoing Detailed Description, it will be understood that the invention is not so limited, but is intended to encompass any equivalents, alternatives, and modifications of elements as fall within the spirit and scope of the invention.

I claim:

1. A drilling mud sampling chamber, which comprises:
- a rigid box having front and back ends, and top and bottom sides;
- a handle secured to the top side of said box;
- said box being of rectangular cross-section which increases in width and decreases in height from the back end of said box to the front end thereof such that the bottom wall is inclined relative to the top wall of said box;
- a sight glass mounted in an opening provided in the top side of said box;
- a fitting mounted in another opening provided in the top side of said box, said fitting being adapted for receiving a hydrocarbon sensor;
- an inlet in the front of said box;
- an outlet in the end of said box, said outlet being positioned beneath said inlet; and
- a hinged trap door covering said outlet.

2. A drilling mud sampling chamber, which comprises:
- a rigid box having front and back ends, and top and bottom sides;
- said box being of rectangular cross-section which increases in width and decreases in height from the back end of said box to the front end thereof such that the bottom wall is inclined relative to the top wall of said box;
- an inlet in the front of said box; and
- an outlet in the end of said box;
- said outlet being positioned at a point below said inlet.

3. A drilling mud sampling chamber, which comprises:
- a rigid box having front and back ends, and top and bottom sides;
- a handle secured to the top side of said box;
- said box being of rectangular cross-section which increases in width and decreases in height from the back end of said box to the front end thereof such that the bottom wall is inclined relative to the top wall of said box;
- an inlet in the front of said box; and
- an outlet in the end of said box.

4. A drilling mud sampling chamber, which comprises:
- a rigid box having front and back ends, and top and bottom sides;
- said box being of rectangular cross-section which increases in width and decreases in height from the back end of said box to the front end thereof such that the bottom wall is inclined relative to the top wall of said box;
- an inlet in the front of said box;
- an outlet in the end of said box; and
- a hinged trap door covering said outlet.

5. A drilling mud sampling chamber, which comprises:
- a rigid box having front and back ends, and top and bottom sides;
- a sight glass mounted in an opening provided in the top side of said box;
- said box being of rectangular cross-section which increases in width and decreases in height from the back end of said box to the front end thereof such that the bottom wall is inclined relative to the top wall of said box;
- an inlet in the front of said box; and
- an outlet in the end of said box.

6. A drilling mud sampling chamber, which comprises:
- a rigid box having front and back ends, and top and bottom sides;
- a fitting mounted in an opening provided in the top side of said box and adapted for connection to a sensor;
- said box being of rectangular cross-section which increases in width and decreases in height from the back end of said box to the front end thereof such that the bottom wall is inclined relative to the top wall of said box;
- an inlet in the front of said box; and
- an outlet in the end of said box.

7. A sampling chamber for use with a sensor in analyzing flowing drilling mud, comprising:
- a rigid box having front and back walls, and top and bottom sides;
- said box being of rectangular cross-section which increases in width and decreases in height from the back wall to the front wall such that the bottom side is inclined relative to the top side of said box;
- an inlet mounted in the front wall of said box;
- an outlet mounted in the back wall of said box, said outlet being positioned beneath said inlet; and
- a fitting mounted in an opening provided in the top side of said box and adapted for receiving the sensor.

8. The sampling chamber of claim 7, further including:
- a handle secured to the top side of said box.

9. The sampling chamber of claim 7, including:
- a hinged trap door covering said outlet.

10. The sampling chamber of claim 7, including:
- a sight glass mounted in an opening provided in the top side of said box.

* * * * *